US007125083B2

(12) United States Patent
Piumarta et al.

(10) Patent No.: US 7,125,083 B2
(45) Date of Patent: Oct. 24, 2006

(54) WHEEL WITH DUAL DENSITY

(75) Inventors: Timothy Piumarta, Soquel, CA (US); Jeremy Fox, Huntington Beach, CA (US)

(73) Assignee: NHS, Inc., Sant Cruz, CA (US)

( * ) Notice: Subject to any disclaimer, the term of this patent is extended or adjusted under 35 U.S.C. 154(b) by 0 days.

(21) Appl. No.: 10/861,596

(22) Filed: Jun. 4, 2004

(65) Prior Publication Data

US 2005/0269862 A1 Dec. 8, 2005

(51) Int. Cl.
*B60B 5/02* (2006.01)

(52) U.S. Cl. ..... 301/5.3; 301/64.7; 152/323; 264/45.7

(58) Field of Classification Search ..... 152/1, 152/5, 7, 23, 310, 311, 313, 393; 301/5.3, 301/5.301, 64.7, 64.702; 280/11.19, 11.22, 280/11.23; 264/262, 255, 45.5, 45.7, 50; 29/898.04

See application file for complete search history.

(56) References Cited

U.S. PATENT DOCUMENTS

| | | | | | |
|---|---|---|---|---|---|
| 3,396,773 | A | | 8/1968 | Alderfer | |
| 3,605,848 | A | | 9/1971 | Lombardi et al. | |
| 4,058,152 | A | * | 11/1977 | Beck et al. | 152/310 |
| 4,208,073 | A | | 6/1980 | Hechinger | |
| 4,294,491 | A | | 10/1981 | Black | |
| 4,387,070 | A | * | 6/1983 | Cunard et al. | 264/247 |
| 4,909,972 | A | | 3/1990 | Britz | |
| 5,129,709 | A | | 7/1992 | Klamer | |
| 5,265,659 | A | | 11/1993 | Pajtas et al. | |
| 5,308,152 | A | | 5/1994 | Ho | |
| 5,312,844 | A | | 5/1994 | Gonsior et al. | |
| 5,401,037 | A | | 3/1995 | O'Donnell et al. | |
| 5,560,685 | A | | 10/1996 | De Bortoli | |
| 5,567,019 | A | | 10/1996 | Raza et al. | |
| 5,632,829 | A | | 5/1997 | Peterson et al. | |
| 5,655,785 | A | | 8/1997 | Lee | |
| 5,725,284 | A | | 3/1998 | Boyer | |
| 5,733,015 | A | | 3/1998 | Demarest et al. | |
| 5,853,225 | A | | 12/1998 | Huang | |
| 5,853,226 | A | * | 12/1998 | Lee | 301/5.309 |
| 5,860,707 | A | * | 1/1999 | Keleny | 301/5.304 |
| 5,906,836 | A | | 5/1999 | Panaroni et al. | |
| 5,922,151 | A | | 7/1999 | Piper et al. | |
| 5,979,993 | A | * | 11/1999 | Huang | 301/5.308 |
| 6,036,278 | A | | 3/2000 | Boyer | |
| 6,050,648 | A | * | 4/2000 | Keleny | 301/64.701 |

(Continued)

*Primary Examiner*—Frantz F. Jules
(74) *Attorney, Agent, or Firm*—Kolisch Hartwell, P.C.

(57) ABSTRACT

A wheel is provided for coupling to a bearing case at an outer cylindrical surface and a lateral annular surface of the bearing case. The wheel includes an inner wheel portion with an annular body defining a central hole with an inner cylindrical surface and a lateral annular surface for engaging the bearing case. The inner wheel portion may substantially comprise a thermoset, polyurethane material having a density and have a surface exhibiting a hardness. The wheel also may include an outer wheel portion bonded to the inner wheel portion. The outer wheel portion may be substantially comprised of the same thermoset, polyurethane material as the inner wheel portion. The outer wheel surface may exhibit a hardness substantially the same as that of the inner wheel surface. The inner wheel material may have a lesser density than that of the outer wheel material. The lesser density of the inner wheel portion may be provided by gas bubbles included in the material of the inner wheel portion, which bubbles may be provided by hollow plastic spheres.

4 Claims, 3 Drawing Sheets

U.S. PATENT DOCUMENTS 6,227,622 B1 5/2001 Roderick et al.
6,450,222 B1 9/2002 Fleming
6,482,140 B1 * 11/2002 Takatsu ..... 492/31
6,592,189 B1 * 7/2003 Back, Sr. ..... 301/5.308
6,629,735 B1 10/2003 Galy

* cited by examiner

WHEEL WITH DUAL DENSITY

BACKGROUND

Skateboards, skates, scooters, and other rolling sports equipment are typically provided with two or more wheels coupled by bearings to the axles of the equipment. The wheels have been made out of a variety of materials to provide desired characteristics, which include resistance to wear, smooth and fast rolling, and a stable connection to the bearings and axles. Another desired characteristic is a light weight for the wheel, which both improves rolling and provides a wheel with less mass, which makes lifting and maneuvering of the equipment easier. Increasing the width and diameter of the wheels improves the rolling characteristic, but at the expense of adding weight. Using a lighter weight material improves rolling but typically the lighter material is softer, resulting in less resistance to wear and a less stable connection to the bearings and axles.

Reducing the weight of the wheels is desirable for a skateboard because it facilitates the board's use in maneuvers or stunts where the board is rotated about its longitudinal, horizontal axis and/or about its central, vertical axis. The wheels are at a distance from both of those axes and thus the wheels provide an inertial moment to which sufficient force must be applied to overcome the moment and rotate the board about the axes. Thus, the lighter the wheels, the easier the rotating stunts can be performed. The moment of the wheels is the product of their weight and the square of the distance from the wheel to the axis, and thus the wheel weight can be of much greater significance than the weight of other components of the skateboard that are closer to the axis.

Past attempts to reduce the weight of the wheels have including simply reducing the size, i.e., the width and diameter of the wheel, but this degrades the rolling characteristics of the wheel. Another approach used a non-polyurethane, thermoplastic, hollow core with a polyurethane riding surface over the core. Some drawbacks of this approach include that the cores can crack or break under load and stress, the cores are heat sensitive, and thus more likely to fail in high or low temperatures, and the cores tend to become more brittle over. Also, the thermoplastic core is unlike the polyurethane riding surfaces in composition, hardness, and rebound properties, making it more difficult to bind the two together and to get good rolling characteristics.

SUMMARY

A wheel according to an embodiment of the present invention may be molded of a thermoset polyurethane material, including an inner wheel portion and an outer wheel portion. The inner wheel portion may be molded with a central hole for an axle and with surfaces for coupling to a bearing case at mating surfaces. The bearing case and the wheel may be connected to the axle by inserting an end of the axle through the central hole of the wheel and a central hole of the bearing case, and holding them in place with a washer and nut combination.

The inner wheel portion is typically molded first, and then shaped as necessary, and reinserted in the mold for casting of the outer wheel portion around the inner wheel portion, although other molding techniques may be used. The outer wheel may be made of the same thermoset, polyurethane material as the inner wheel portion. Each of the wheel portions will have a surface that exhibits a hardness and the polyurethane material will be selected for a particular density. Typically the hardness of the surfaces will be substantially the same on the two wheel portions, while the density of the inner wheel portion will be less than the density of the outer Wheel portion. The lesser density of the inner wheel portion may be provided by air bubbles included in the material of the inner wheel portion.

DETAILED DESCRIPTION

Figure 1:
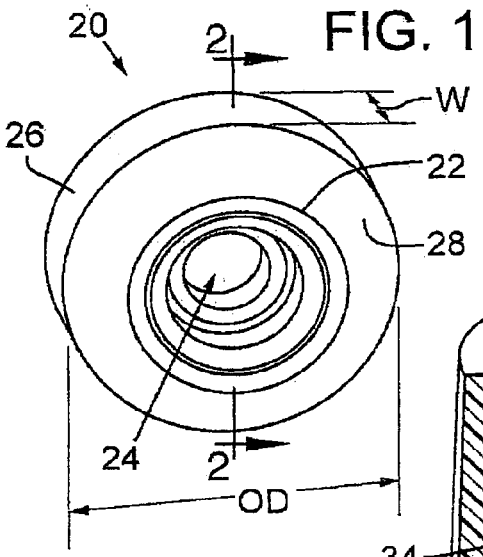
FIG. 1 is an isometric view of a wheel according to an embodiment of the present invention, showing an outer rolling surface of an outer wheel portion, and a central hole and surfaces of an inner wheel portion for coupling to an axle and a bearing case.
Figure 2:
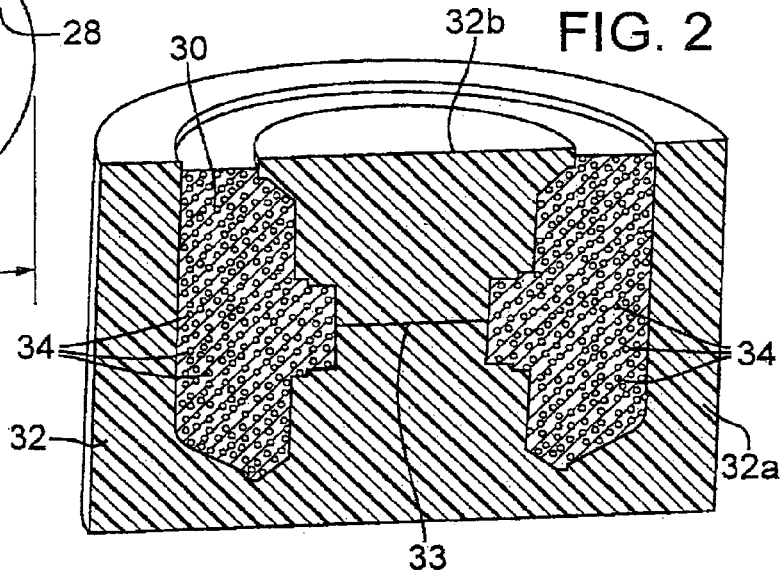
FIG. 2 is a cross-sectional view of the inner wheel portion of the wheel in a mold showing air bubbles entrained in the material of the inner wheel portion.

A wheel, indicated generally at 20 in FIG. 1, in accordance with the present invention may be molded to a desired outer diameter OD. The wheel may include a generally annular body 22 defining a central hole 24, and may be shaped to a desired profile, typically including a cylindrical outer rolling surface 26 having a width W, and a curved, beveled edge 28.

The wheel is typically formed of a thermoset, polyurethane material, which is made by mixing a resin material, and a set material, e.g., Vibrathane 821 and HQEE or 1, 4 Butanediol made by Crompton Uniroyal Chemical. An inner wheel portion 30 of wheel 20 may be formed in a mold 32, preferably by pouring the polyurethane material at an appropriate point in time after mixing and allowing the material to harden in the mold with or without added heat for curing. Mold 32 includes walls shaped to provide the inner wheel portion with desired surfaces to be described in greater detail below. Mold 32 preferably is in two halves 32*a* and 32*b* that mate at a parting line 33 allowing removal of inner wheel portion 30.

Preferably, inner wheel portion 30 will include air bubbles 34 distributed throughout the polyurethane material, which provide the inner wheel portion with a lower density than would be the case for the polyurethane material alone. Air bubbles may be introduced by adding small, hollow plastic spheres, referred to as microspheres, into the polyurethane either prior to or at the time of injection into mold 32. E.g., microspheres sold by Akzo Nobel under the mark EXPANCEL may be used.

Each EXPANCEL microsphere consists of a thermoplastic shell encapsulating a hydrocarbon gas. The EXPANCEL microspheres are originally formed in an unexpanded state and have the appearance of a solid plastic granule. The microspheres are formed by compounding a thermoplastic granule with a blowing agent. Unexpanded EXPANCEL microspheres (EXPANCEL WU or DU) have a diameter between about 6 μm and about 40 μm, depending on grade. When unexpanded EXPANCEL® microspheres are heated they expand to between about 20 μm and about 150 μm in diameter.

In forming the inner wheel portion, typically, unexpanded microspheres are added to the polyurethane material prior to injection. In that case, the combined polyurethane material and microspheres are injected into the mold and heat is applied while the material cures, and the heat expands the microspheres. Alternatively, microspheres that have been pre-expanded by heating may be added to the material.

Typically the microspheres in the pre-expanded state are added during injection by metering a selected ratio of the microspheres into the injection flow. Alternatively the gas bubbles may be added by addition of a blowing agent such as $H_2O$ at the time of injection. In either case, a density may be selected for the inner wheel portion by selection of the polyurethane material and the amount and type of added gas bubbles.

Figure 4:
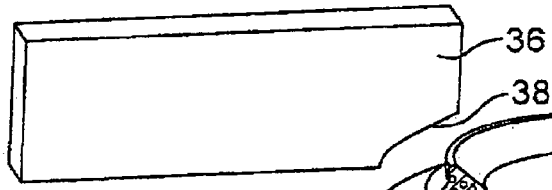
FIG. 4 is a cross-sectional view of the inner wheel portion showing a shaping tool for cutting away the material to form a curved, beveled edge on the inner wheel.
Figure 4:
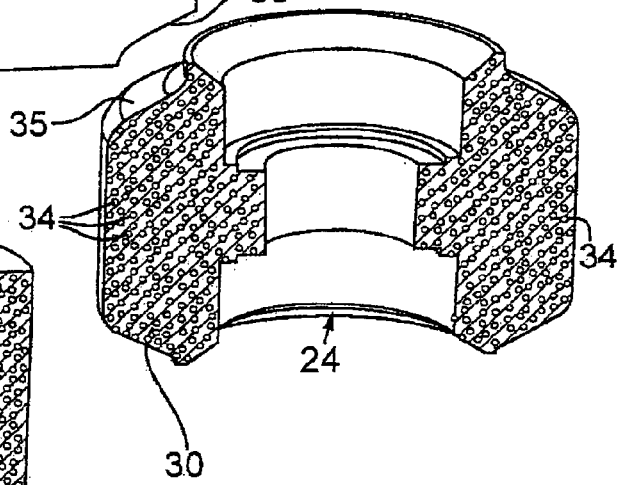
Figure 3:
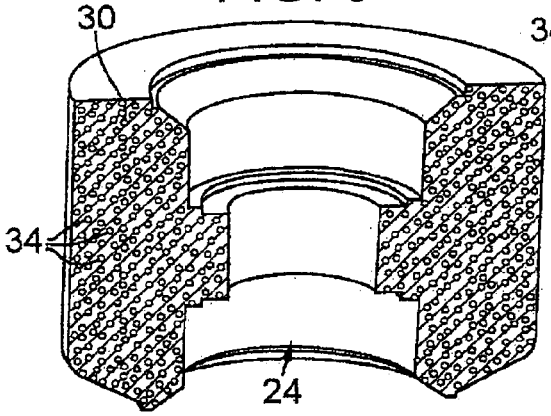
FIG. 3 is a cross-sectional view of the inner wheel portion removed from the mold, showing the central hole and the cylindrical and annular surfaces for coupling to an axle via a bearing case.

Inner wheel portion 30, after molding, may be removed from the mold, as shown in FIG. 3. The inner wheel may be shaped, e.g., by beveling an outer surface of the inner wheel into a curved or other shape 35, as shown in FIG. 4. Alternatively, the inner wheel may be molded to its final shape in the mold, or additional post-molding shaping may be performed. A cutting tool, such as knife 36 with a cutting edge 38 may be used to cut away material of inner wheel portion 30, typically by spinning the inner wheel on a lathe, until the desired shape is reached. A curved or beveled edge may provide a greater surface area on the inner wheel for subsequent bonding thereto of the outer wheel portion.

Figure 5:
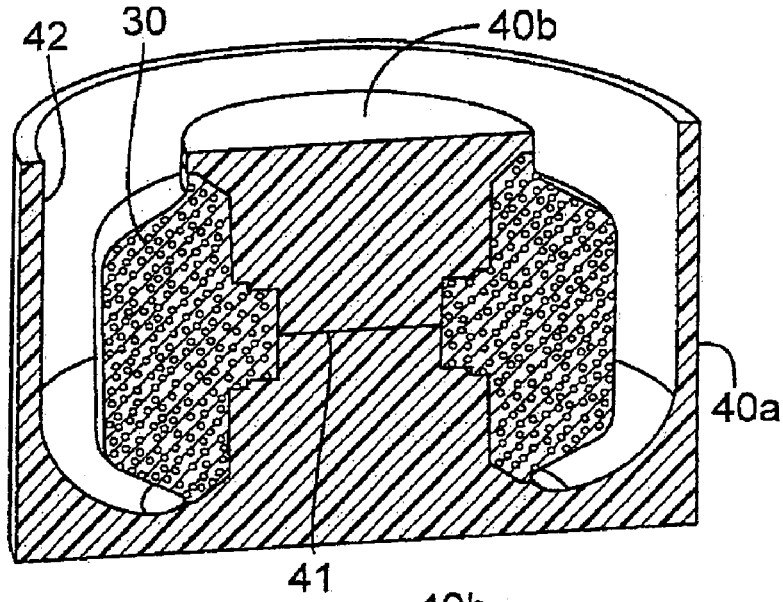
FIG. 5 is a cross-sectional view of the shaped inner wheel portion inserted in a mold for forming the outer wheel portion around the inner wheel portion, showing the mold walls providing the space for the outer wheel portion.

As shown in FIG. 5, when inner wheel portion 30 is in the desired final shape, it is preferably inserted in a mold 40 that generally mates to the surfaces of inner wheel portion 30 in central hole 24. Mold 40 is preferably in two halves 40*a* and 40*b* that mate at center line 41. Mold 40 includes a mold wall 42 to provide an outer surface of the outer wheel portion.

Figure 6:
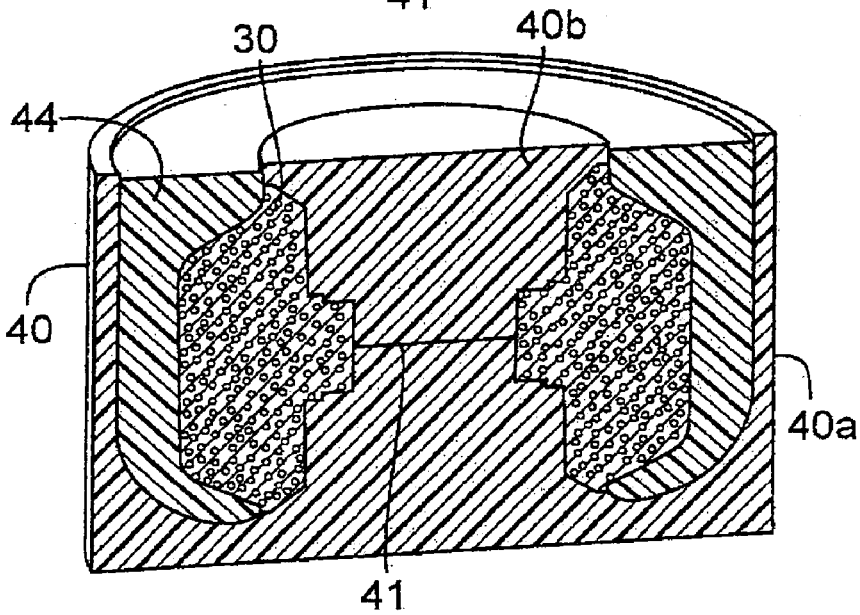
FIG. 6 is a cross-sectional view of the wheel in the mold with the inner wheel portion and outer wheel portion bonded together in the molding process.

As shown in FIG. 6, an outer wheel portion 44 is formed around inner wheel portion 30, preferably using substantially the same thermoset, polyurethane material as was used to form the inner wheel portion. Typically, the liquid polyurethane material injected into mold 40 to produce the outer wheel portion bonds intimately with the inner wheel portion because of the molding process and the use of substantially the same type of polyurethane. Preferably the outer wheel portion includes no material added to produce gas bubbles and thus is substantially free of gas bubbles. Alternatively, however, gas bubbles may be produced in outer wheel portion 44. Alternatively, a more dense agent may be added to the outer wheel portion. It will be understood that, preferably, the materials of the inner and outer wheel portions are substantially the same, regardless of the presence of absence gas bubbles or an agent for producing gas bubbles or other materials in either portion.

In any case, inner wheel portion 30 is preferably substantially less dense than outer wheel portion 44. Preferably the density of the inner wheel material is between about 0.60 grams per 1 cubic centimeter and about 0.90 grams per cubic centimeter, and other ranges may be used. Preferably, the density of the outer wheel material is between about 1.1 grams per 1 cubic centimeter and about 1.3 grams per 1 cubic centimeter, and other ranges may be used. A preferred ratio of the density of the inner wheel material to the density of the outer wheel material is between about 0.6 and about 0.95. In a typical wheel, gas bubbles are added to the inner wheel portion to produce a 30% reduction in density, which, if the outer wheel portion is substantially unchanged, would produce a ratio of 0.70.

Figure 7:
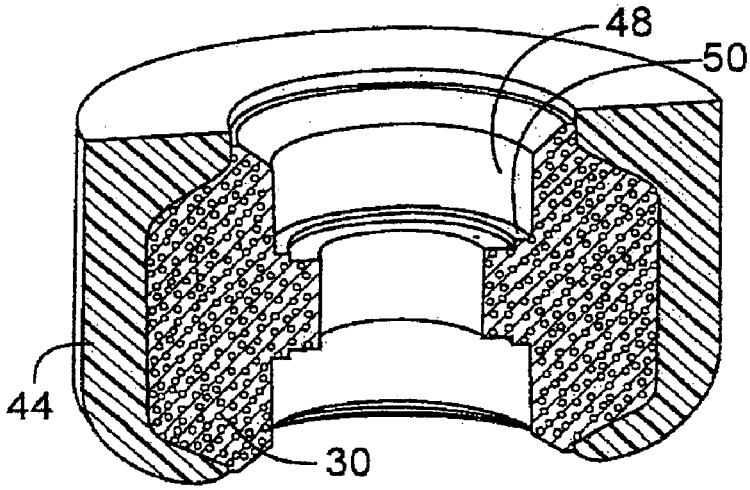
FIG. 7 is a cross-sectional view of the wheel removed from the mold.
Figure 8:
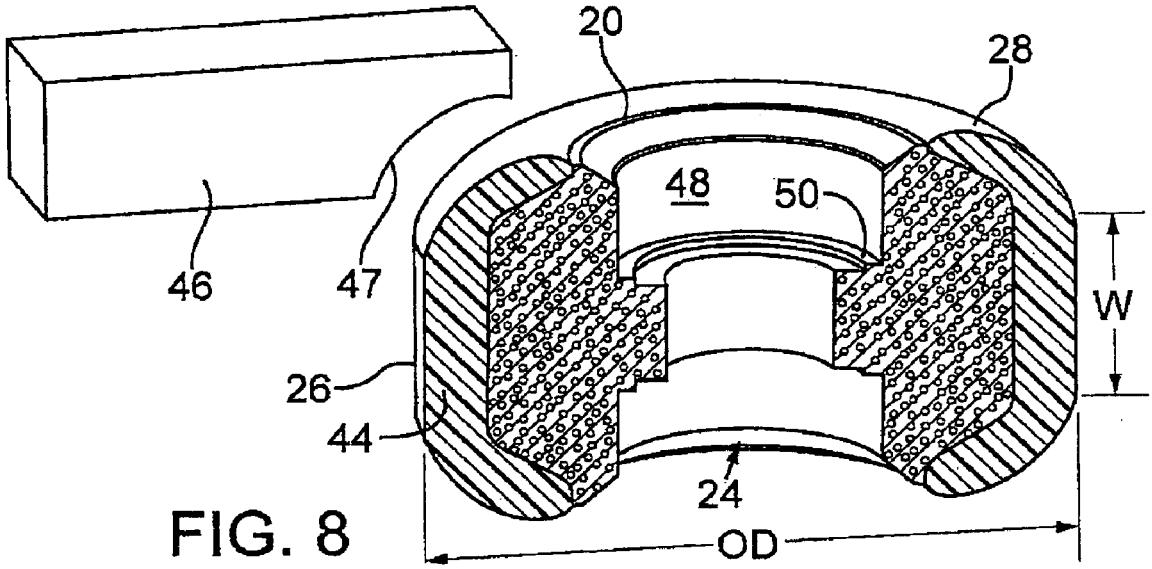
FIG. 8 is a cross-sectional view of the wheel showing a cutting tool for cutting away material to form a curved, beveled edge on the outer wheel portion.

As shown in FIGS. 7 and 8, after molding, wheel 20 may be removed from mold 40 and shaped, e.g., by beveling an outer surface of the outer wheel into a curved edge 16 or other shape. Alternatively, the outer wheel may be molded to its final shape in the mold, or additional post-molding shaping may be performed on either or both of the inner and outer wheel portions. A cutting tool, such as knife 46 with a cutting edge 47 may be used to cut away material of outer wheel portion 44, typically by spinning the wheel on a lathe, until the desired shape is reached.

Outer wheel portion 44 thus includes outer cylindrical surface 26 and other surfaces that exhibit a measurable hardness. Inner wheel portion 32 includes surfaces that exhibit a measurable hardness, such as inner cylindrical surface 48 and lateral annular surface 50. Preferably the inner and outer wheel surfaces exhibit substantially the same degree of hardness. For example, the hardnesses of the inner and outer wheel portions may be between about 97 and about 100 on Shore scale A and between about 50 and about 60 on Shore scale D, although other hardnesses may be provided through selection and molding of the polyurethane material.

Figure 9:
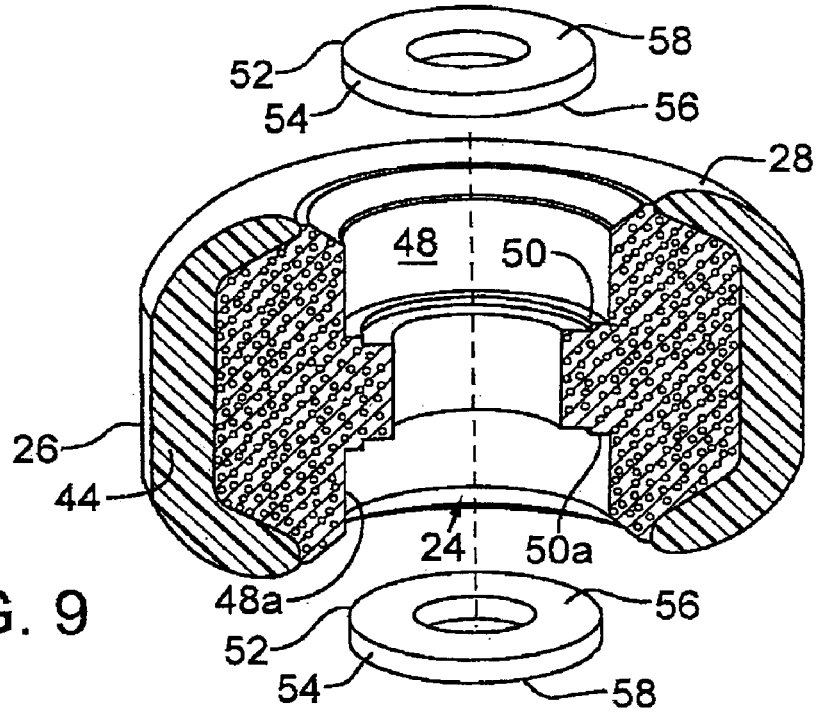
FIG. 9 is a cross-sectional view of the wheel showing in an exploded view two bearing cases with cylindrical and annular surfaces for coupling to mating surfaces on the wheel and to a nut and/or washer for connection to the axle.

As best seen in FIG. 9, wheel 20 may coupled to an axle adjacent central hole 24, preferably by coupling to a bearing case 52 at an outer cylindrical surface 54 and a lateral annular surface 56 of the bearing case. The surfaces 54, 56 of the bearing case are preferably sized to fit snugly into the inner cylindrical surface 48 and lateral annular surface 50 in central hole 24 of wheel 20. Typically a second bearing case 52 is fitted into central hole 24 of wheel 20 to be coupled to an inner cylindrical surface 48*a* and lateral annular surface 50*a*.

Preferably the bearing cases are substantially identical to one another, and thus so are the inner cylindrical and lateral annular surfaces of the wheel. Different bearing cases may be used however, preferably with appropriately mating wheel surfaces. Each bearing case typically includes a second annular surface 58 opposite to first annular surface 56, and the bearings within the case allow these surfaces to rotate freely with respect to one another. Thus, the second annular surfaces 58 of the bearing cases may be fixedly attached to the axle, e.g., by a washer and nut combination screwed onto a threaded portion of the axle, to allow the wheel to be freely rotatable relative to the axle.

The subject matter described herein includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements. It is believed that the following claims particularly point out certain combinations and subcombinations that are directed to one of the disclosed embodiments and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the present disclosure.

What is claimed is:

1. A method for constructing a wheel for coupling to a bearing ring, the method comprising:

providing a polyurethane material prepared to be cured to a thermoset condition, the material when thermoset having a measurable hardness;

providing a first mold for molding an inner wheel portion;

filling the inner wheel mold with the polyurethane material;

producing gas bubbles in the polyurethane material in the inner wheel mold;

releasing the inner wheel portion from the mold;

providing a second mold for molding an outer wheel portion;

inserting the inner wheel portion in the outer wheel mold;

filling the outer wheel mold with the polyurethane material to create the outer wheel portion and to bond the wheel portions together;

releasing the bonded inner and outer wheel portions from the outer wheel mold, wherein the step of producing gas bubbles in the inner wheel portion includes adding hollow plastic spheres to the polyurethane material contemporaneously with filling the inner wheel mold with the material.

2. The method of claim 1 wherein the hollow plastic spheres are unexpanded when added to the polyurethane material.

3. The method of claim 1 wherein the hollow plastic spheres are pre-expanded before adding to the polyurethane material.

4. A method for constructing a wheel for coupling to a bearing ring, the method comprising:

providing a polyurethane material prepared to be cured to a thermoset condition, the material when thermoset having a measurable hardness;

providing a first mold for molding an inner wheel portion;

filling the inner wheel mold with the polyurethane material;

producing gas bubbles in the polyurethane material in the inner wheel mold;

releasing the inner wheel portion from the mold;

providing a second mold for molding an outer wheel portion;

inserting the inner wheel portion in the outer wheel mold;

filling the outer wheel mold with the polyurethane material to create the outer wheel portion and to bond the wheel portions together;

releasing the bonded inner and outer wheel portions from the outer wheel mold, wherein the step of producing gas bubbles in the inner wheel portion includes introducing a blowing agent into the polyurethane material contemporaneously with filling the inner wheel mold with the material.

* * * * *